United States Patent [19]

Gräf

[11] Patent Number: 4,494,999

[45] Date of Patent: Jan. 22, 1985

[54] PROCESS FOR MAKING FINE-GRAIN WELDABLE STEEL SHEET FOR LARGE-DIAMETER PIPES

[75] Inventor: Michael Gräf, Ratingen, Fed. Rep. of Germany

[73] Assignee: Mannesmann Aktiengesellschaft, Düsseldorf, Fed. Rep. of Germany

[21] Appl. No.: 512,450

[22] Filed: Jul. 11, 1983

[30] Foreign Application Priority Data

Jul. 9, 1982 [DE] Fed. Rep. of Germany ..... 3226160

[51] Int. Cl.[3] ..... C21D 7/14

[52] U.S. Cl. ..... 148/2; 148/12 F

[58] Field of Search ..... 148/12 F, 2

[56] References Cited

U.S. PATENT DOCUMENTS

| | | | |
|---|---|---|---|
| 3,945,858 | 3/1976 | Matsubara et al. | 148/2 |
| 4,020,312 | 4/1977 | Araki et al. | 148/12 F |
| 4,105,474 | 8/1978 | Nakasugi et al. | 148/12 F |
| 4,137,104 | 1/1979 | Nashiwa et al. | 148/12 F |
| 4,138,278 | 2/1979 | Nakasugi et al. | 148/12 F |

*Primary Examiner*—W. Stallard

*Attorney, Agent, or Firm*—Karl F. Ross; Herbert Dubno

[57] ABSTRACT

Microalloyed steel containing, among other ingredients, at least 0.02% niobium, between 0.005 and 0.01% nitrogen, and titanium in a proportion equaling about 3.5 to 4 times that of nitrogen is continuously cast into a slab which is heated to a temperature between about 1120° and 1160° C. whereby titanium nitride precipitates in particles ranging between about 0.06 and 0.2μ. The slab is thermomechanically treated at this temperature and after intermediate cooling in several hot-rolling stages, with an initial deformation of at least 55%; after final rolling, the slab is cooled in water at a rate of at least 10° C. per second to a temperature of about 500° to 550° C. Niobium, which goes into solution at the elevated initial temperature, forms NbC precipitates during the subsequent treatment; this has a hardening and grain-refining effect.

19 Claims, No Drawings

PROCESS FOR MAKING FINE-GRAIN WELDABLE STEEL SHEET FOR LARGE-DIAMETER PIPES

FIELD OF THE INVENTION

My present invention relates to a process for the production of weldable, fine-grain microalloyed steel sheets capable of being used in the manufacture of large-diameter tubes or pipes.

BACKGROUND OF THE INVENTION

Steels conventionally used in making such sheets generally have the following composition, by weight:

| | |
|---|---|
| carbon | 0.05 to 0.07% |
| manganese | 1.5 to 2.0% |
| titanium | 0.01 to 0.04% |
| sulfur | 0.001 to 0.003% |
| nitrogen | 0.005 to 0.008% |
| silicon | 0.25 to 0.40% |
| aluminum | 0.03 to 0.05% |
| niobium | up to 0.08% |
| remainder iron and usual impurities (possibly including calcium) | |

Slabs formed by continuous casting from such a composition, at a temperature of not more than 850° C., are thermomechanically treated with a degree of deformation of at least 60% in an initial hot-rolling stage, followed by final hot rolling at a temperature of 750° to 650° C.

Reference in this connection may be made, for example, to German laid-open specifications Nos. 30 12 139 and 31 46 950. According to the processes described there, the proportion of titanium lies in the range of 0.008 to 0.025% by weight, without observation of any particular ratio between the amounts of titanium and nitrogen. As is apparent from the foregoing table, the art does not consider niobium an essential alloying ingredient. The requisite hardening and grain refining are conventionally controlled by the precipitation of titanium nitride, TiN, which the art endeavors to create in the form of a multitude of fine particles not exceeding 0.05 micron in size. The conventional technique therefore involves a rapid cooling of the slabs after their continuous casting, care being taken to prevent the coarsening of the TiN precipitates during the further treatment so that the fine particles are preserved after final rolling. For the latter purpose it has been proposed to limit the annealing temperature of the slabs before rolling to a range of 950° to 1050° C. (German specification No. 31 46 950) or 900° to 1000° C. (German specification No. 30 12 139). The fine TiN precipitates are expected to impede the growth of austenitic grains and to obviate the formation of coarse particles in the thermally affected zones of weld seams.

Under certain conditions of use, as where pipes are to carry fluids at substantial pressure in regions of permanent frost, the mechanical properties of conventionally produced steel sheets fail to satisfy essential criteria of tensile strength and elastic limit, for example. Attempts have been made to improve these properties by the addition of niobium, usually in combination with substantial quantities of such relatively costly metals as vanadium, nickel and chromium. At least in the absence of these latter metals, however, the niobium does not significantly contribute to the stress resistance of steel sheets whose hardness is predominantly determined by TiN precipitates. The reasons for the unsatisfactory performance of niobium, I have found, reside in the insufficient solution thereof at the relatively low annealing temperature of the continuously cast slabs as well as in the formation of counterproductive compounds. Thus, a low proportion of titanium favors the formation of strength-reducing niobium carbon nitride, NbCN, whereas an excessive percentage of titanium leads to the formation of ductility-impairing titanium carbide, TiC.

OBJECT OF THE INVENTION

The object of my present invention, therefore, is to provide an improved process for the making of weldable steel sheets of greater strength and ductility, enabling their use in the manufacture of large-diameter pipes for the conveyance of fluids under adverse climatic conditions.

SUMMARY OF THE INVENTION

I have found, in accordance with my present invention, that this object can be realized with a microalloyed steel having generally the composition given above wherein, however, a specific quantitative relationship is maintained between the titanium and the nitrogen, namely a ratio ranging between about 3.5:1 and 4:1. The composition further includes, as an essential element, niobium in a minimum proportion of 0.02% by weight, up to the aforestated maximum of 0.08% but preferably with an upper limit of 0.06%. The proportion of nitrogen does not exceed about 0.01% by weight.

Upon the continuous casting of a slab from such a composition, the slab is heated to an elevated temperature between essentially 1120° and 1160° C. Beginning at this elevated temperature, the slab is subjected to a succession of hot-rolling stages with intervening cooling, including an initial deformation to a degree of at least 55%. I have found that the niobium, going into solution at the elevated temperature referred to, forms its carbide NbC during the subsequent treatment to the virtual exclusion of TiC; the precipitated NbC essentially controls the hardening and grain refining while the role of the titanium is virtually limited to that of binding the nitrogen and preventing the formation of NbCN during the first cooling step. The enlargement of TiN particles, carefully avoided in the known processes discussed above, is no longer objectionable in view of the controlling effect of NbC; in fact, the grain sizes of precipitated TiN may range from about 0.06 up to about 0.2 microns as a result of the high annealing temperature. The tensile strength of the resulting steel sheet is enhanced and the ductility is improved with reduced tendency to crack; the sheets are particularly suitable for welding into large-diameter tubes for pipelines laid in permafrost regions.

The described advantageous effects are particularly noticeable when the proportion of titanium lies above 0.025%, preferably above 0.03%, by weight.

The elevated annealing temperature referred to should be maintained for a time whose duration is not critical but which ought to be sufficient to let virtually the entire niobium go into solution in the austenitic structure. This duration can be readily determined by experimentation and is ascertainable from the growth of the TiN precipitates within the limits given above. This will generally occur already during the heating-up stage, i.e. prior to the spread of the desired maximum temperature throughout the slab.

According to a more particular feature of my invention, the initial heating and hot rolling is followed by a thermomechanical deformation in another hot-rolling stage at an intermediate temperature which does not exceed substantially 850° C. and preferably lies between 820° and 790° C. Final hot rolling advantageously takes place thereafter at a reduced temperature not less than substantially 650° C., preferably between about 700° and 680° C.

The favorable properties of a steel sheet made in accordance with the steps just described can be further enhanced, pursuant to yet another feature of my invention, by water-cooling the slabs after final rolling, at a rate of at least 10° C. but preferably in excess of 15° C. per second, to a lower temperature between substantially 550° and 500° C. Thereafter, the slabs are cooled in air down to room temperature. This measure, I have found, brings about an additional increase in tensile strength and elastic limit without loss of ductility (e.g. as determined by the known Drop-Weight Tear Test and Charpy V-Notch procedures) and without the need for additional alloying elements.

EXAMPLE

A continuously cast slab with a thickness of 200 mm contains, besides iron and the usual impurities, 0.07% C, 1.88% Mn, 0.033% Ti, 0.042% Nb, 0.0083 N, 0.35% Si, 0.04% Al and 0.0018% S, all percentages being again by weight. The slab is heated to a temperature of 1150° C. in a first step in which the niobium goes into solution by the time that a uniform temperature has been attained. At this temperature the slab is drawn and subjected to hot rolling to a thickness of 80 mm which corresponds to a degree of deformation of 60%. This is followed by cooling in calm air down to 790° C. whereupon the slab thickness is reduced in another hot-rolling stage to 30 mm, corresponding to a deformation of 62.5%. Further cooling lowers the slab temperature to 680° C. and the workpiece is then hot rolled to a final thickness of 20 mm, yielding a raw sheet whose temperature lies between 690° and 720° C. After cooling to room temperature the sheet exhibits the following properties:

| | |
|---|---|
| yield point | 512 N(Newtons)/mm$^2$ |
| tensile strength | 617 N/mm$^2$ |
| A5 breaking elongation | 21% |
| notch impact strength | 210 J at −20° C. |
| transition temperature | TU 85% BDWTT = −40° C. |
| transition temperature | TU Cv 100 = −80° C. |

The sheet has a ferritic-pearlitic structure with a grain size of 11 to 12 ASTM.

When such sheets, immediately after final hot rolling, are cooled in water at a rate of 10° C. per second down to 500° C. and thereafter in air to room temperature, the following improved technological properties are observed:

| | |
|---|---|
| yield point | 657 N/mm$^2$ |
| tensile strength | 658 N/mm$^2$ |
| A5 breaking elongation | 21% |
| notch impact strength | 215 J at −20° C. |
| transition temperature | TU 85% BDWTT = −40° C. |
| transition temperature | TU Cv 100 = −80° C. |

The sheets so treated have a ferritic-bainitic structure with a grain size less than 12 ASTM.

In order to obtain a shorter cooling period, the foregoing quenching rate can be raised above 15° C. per second with similarly improved results.

I claim:

1. A process for producing fine-grain microalloyed steel sheets suitable for welding into large-diameter pipes, comprising the steps of:

(a) providing a composition consisting essentially, by weight, of 0.05 to 0.07% carbon, 1.5 to 2.0% manganese, 0.001 to 0.003% sulfur, 0.005 to 0.008% nitrogen, titanium in a proportion of substantially 3.5 to 4 times that of nitrogen, 0.25 to 0.40% silicon, 0.03 to 0.05% aluminum, 0.02 to 0.08% niobium, remainder iron and usual impurities;

(b) continuously casting said composition into slabs;

(c) heating said slabs to an elevated temperature between substantially 1120° and 1160° C., with resulting formation of TiN precipitates having particle sizes between about 0.06 and 0.2 microns; and (d) subjecting the slabs to a succession of hot-rolling stages with intervening cooling, including an initial deformation to a degree of at least 55% beginning at said elevated temperature.

2. A process as defined in claim 1 wherein the proportion of titanium is above 0.025%.

3. A process as defined in claim 1 wherein the proportion of titanium is above 0.03%.

4. A process as defined in claim 1 wherein the proportion of nitrogen is substantially 0.008%.

5. A process as defined in claim 1 wherein said initial deformation is followed by a thermomechanical deformation at an intermediate temperature not exceeding substantially 850° C.

6. A process as defined in claim 5 wherein said intermediate temperature lies between about 820° and 790° C.

7. A process as defined in claim 5 wherein said thermomechanical deformation is followed by a final rolling at a reduced temperature not less than substantially 650° C.

8. A process as defined in claim 7 wherein said reduced temperature lies between about 700° and 680° C.

9. A process as defined in claim 7 wherein said final rolling is followed by a cooling of the slabs in water, at a rate of at least 10° C. per second, to a lower temperature between substantially 550° and 500° C., the slabs being then further cooled in air to room temperature.

10. A process as defined in claim 9 wherein said rate exceeds 15° C. per second.

11. A process as defined in claim 1 wherein the proportion of niobium does not exceed 0.06%.

12. A process for producing fine-grain microalloyed steel sheets suitable for welding inot large-diameter pipes, comprising the steps of:

(a) providing a composition consisting essentially, by weight, of 0.05 to 0.07% carbon, 1.5 to 2.0% manganese, 0.001 to 0.003% sulfur, up to about 0.01% nitrogen, titanium 0.01 to 0.04% in an amount equaling substantially 3.5 to 4 times that of nitrogen, 0.25 to 0.40% silicon, 0.03 to 0.05% aluminum, 0.02 to 0.08% niobium, remainder iron and usual impurities;

(b) continuously casting said composition into slabs;

(c) heating said slabs to an elevated temperature between substantially 1120° and 1160° C., with resulting formation of TiN precipitates having particle sizes between about 0.06 and 0.2 microns; and (d) subjecting the slabs to a succession of hot-rolling stages with intervening cooling, including an initial deformation to a degree of at least 55% beginning at said elevated temperature.

13. A process as defined in claim 12 wherein said initial deformation is followed by a thermomechanical deformation at an intermediate temperature not exceeding substantially 850° C.

14. A process as defined in claim 13 wherein said intermediate temperature lies between about 820° and 790° C.

15. A process as defined in claim 13 wherein said thermomechanical deformation is followed by a final rolling at a reduced temperature not less than substantially 650° C.

16. A process as defined in claim 15 wherein said reduced temperature lies between about 700° and 680° C.

17. A process as defined in claim 15 wherein said final rolling is followed by a cooling of the slabs in water, at a rate of at least 10° C. per second, to a lower temperature between substantially 550° and 500° C., the slabs being then further cooled in air to room temperature.

18. A process as defined in claim 17 wherein said rate exceeds 15° C. per second.

19. A process as defined in claim 12 wherein the proportion of niobium does not exceed 0.06%.

* * * * *